US012104873B1

(12) United States Patent
Damoth et al.

(10) Patent No.: US 12,104,873 B1
(45) Date of Patent: Oct. 1, 2024

(54) CARTRIDGE MAGAZINE

(71) Applicant: AMEND2, LLC, Idaho Falls, ID (US)

(72) Inventors: Austin Damoth, Idaho Falls, ID (US); Craig Lockwood, Idaho Falls, ID (US)

(73) Assignee: Amend2, LLC, Idaho Falls, ID (US)

( * ) Notice: Subject to any disclaimer, the term of this patent is extended or adjusted under 35 U.S.C. 154(b) by 0 days.

(21) Appl. No.: 18/199,830

(22) Filed: May 19, 2023

(51) Int. Cl.
*F41A 9/61* (2006.01)

(52) U.S. Cl.
CPC ..... *F41A 9/61* (2013.01)

(58) Field of Classification Search
CPC ..... F41A 9/65; F41A 9/64; F41A 9/69; F41A 9/61; F41A 9/71
USPC ..... 42/49.01, 49.02, 50
See application file for complete search history.

(56) References Cited

U.S. PATENT DOCUMENTS 10,655,924 B2 * 5/2020 Coombs ..... F41A 9/69
2015/0226504 A1 * 8/2015 Faifer ..... F16F 1/04 267/180

* cited by examiner

*Primary Examiner* — Reginald S Tillman, Jr.
(74) *Attorney, Agent, or Firm* — Travis Banta; Loyal IP Law, PLLC

(57) ABSTRACT

A cartridge magazine includes a first wall, a second wall, a third wall, and a fourth wall. A first wall may include a recess disposed in a thickness of the first wall. The recess may extend from a top side of the cartridge magazine along at least a portion of the first wall of the cartridge magazine. In one embodiment, the first wall may be a front wall, where the recess is disposed within a thickness of the front wall of the magazine. The recess may extend from a top side of the cartridge magazine along at least a portion of the front wall of the cartridge magazine. The cartridge magazine may include a plurality of walls.

20 Claims, 3 Drawing Sheets

CARTRIDGE MAGAZINE

BACKGROUND

Development of an ammunition cartridge, which contained all the components necessary to fire a projectile from a firearm in one object, revolutionized firearms technology. Ammunition cartridges include a metallic case, preferably brass, fitted to accept a primer of an appropriate size, gunpowder, and a projectile. More commonly, a cartridge is referred to as a "bullet" even though the projectile, the bullet, is but one element of an ammunition cartridge. One of the reasons for this clarification is that ammunition cartridges are made in different sizes. For example, a brass case may be a particular size, provide a primer pocket for receiving a primer of a particular size, have an internal volume of a specific size to receive gun powder, and may further accept a bullet of a particular size. Ammunition cartridges are typically referred to by distinguishing characteristics of the cartridge. For example, cartridges that include bullets that are 0.22 inches in diameter (e.g., .22 caliber) are typically referred to as "twenty twos."

One problem with this nomenclature is that there are a number of different .22 caliber ammunition cartridges. Thus, these other cartridges are combined with another word to uniquely identify the specific cartridge being referred to. For example, 22 Short, 22 Long, 22 Long Rifle (which is typically referred to and understood as the "twenty two"), 223 Remington, 220 Swift, are all .22 caliber bullets although the dimensions of the brass case associated with each caliber require differences in the guns that will chamber these various rounds. Accordingly, other nomenclatures have been developed to refer to a particular .22 caliber. For example, one person may explain to another that a particular rifle is a 22 Short which means that a 22 Long Rifle cartridge will not fit in the rifle because of the differences in a size of the casing associated with the round (the 22 Long Rifle implements a physically longer case than a 22 Short).

To further complicate matters, commonly known and understood terms in the United States may also have international designations, which are typically identified in millimeters. For example, a 5.56 mm bullet is a .223 caliber bullet. With relatively minor differences, any firearm that accepts a 5.56 mm NATO cartridge will also accept a .223 Remington cartridge (but not necessarily the other way around). Hundreds, if not thousands of different cartridges have been developed for a host of different uses. Many of these cartridges are derivatives of other more "standard" cartridges. A "standard" cartridge is typically one that has been used by a military as a general issue caliber or refers to a cartridge that has been standardized by Sporting Arms and Ammunition Manufacturers' Institute (SAAMI). Examples of standard cartridges may include 5.56×45 mm NATO (223 Remington in the United States), 30-06 Springfield, 7.62×51 mm (NATO—which in the United States is referred to as a .308, 7.62×39 (developed by the former Soviet Union), 9 mm, 45 ACP, and a number of others. Wildcatters, as they are known, are people who experiment on different caliber cartridges to examine the ballistics of each cartridge they have developed. Several "wildcat" cartridges have been developed into readily available cartridges today.

One difficult aspect of wildcat cartridges is that standard calibers, case dimensions, primer types, gunpowder loads, and etc. are not readily available to other shooters. Thus, only the very best wildcat cartridges become standardly available cartridges, frequently because the ballistics of a particular wildcat cartridge surpass what is currently available in standard cartridges. One particular issue with such wildcat cartridges is that they are frequently loaded in a manner different from a "parent" round, or the round that the wildcat cartridge is based on. One example may be the .300 RCM case which can be "necked down" to accept a smaller bullet than what the case was originally designed for. The 0.30 inch opening in the case may be reduced to accept a 6.5 mm bullet, for example. In some cases, however, in order to get the maximum power out of a particular case, such as the .300 RCM case, a 6.5 millimeter bullet, such as used in a cartridge known as a 6.5 PRC ("precision rifle cartridge") may be seated within the .300 RCM case in a manner extends an overall length of the cartridge beyond what will fit in a standard cartridge magazine for a short action rifle. Thus, these 6.5 PRC cartridges are too long to fit in a standard cartridge magazine associated with, for example, a short action rifle.

Initial solutions to allow the 6.5 PRC cartridge to fit into a magazine that fits into a short action rifle were metallic magazines, typically made using steel. Metallic magazines, while functional, are typically require exacting tolerances and can be easily fouled by dirt or residue in the magazine. Polymer magazines, on the other hand, are reliable and tend to function even when fouled. However, polymer magazines typically have thicker walls than metallic magazines to provide necessary structural resilience for a magazine. In this particular case, polymer magazines, as historically made, cannot accept a 6.5 PRC cartridge because the walls of the magazine are too thick and cause the opening of a short action rifle magazine to be shorter than the required overall length of the 6.5 PRC cartridge.

It is, therefore, one object of this disclosure to provide a polymer or polymer hybrid cartridge magazine that accepts a 6.5 PRC cartridge for use in a short action rifle action. It is another object of this disclosure to provide a cartridge magazine that provides an ammunition follower which does not rely on contact with a front wall of a magazine to orient ammunition in the magazine. It is a further object of this disclosure to provide a magazine with a front wall that reduces in thickness at at least one point along a height of a 6.5 PRC magazine.

SUMMARY OF THE DISCLOSURE

Disclosed herein is a cartridge magazine. The cartridge magazine includes a first wall, a second wall, a third wall, and a fourth wall. A first wall may include a recess disposed in a thickness of the first wall. The recess may extend from a top side of the cartridge magazine along at least a portion of the first wall of the cartridge magazine.

Also disclosed is a cartridge magazine. The cartridge magazine may include a front wall, where a recess is disposed within a thickness of the front wall of the magazine. The recess may extend from a top side of the cartridge magazine along at least a portion of the front wall of the cartridge magazine. The cartridge magazine may include a plurality of walls.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified.

Advantages of the disclosure will become better understood with regard to the following description and accompanying drawings where.

DETAILED DESCRIPTION

The disclosure extends to cartridge magazines which may be used with various calibers of cartridges in a short action rifle action.

In the following description of the disclosure, reference is made to the accompanying drawings, which form a part hereof, and in which is shown by way of illustration specific implementations in which the disclosure is may be practiced. It is understood that other implementations may be utilized and structural changes may be made without departing from the scope of the disclosure.

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
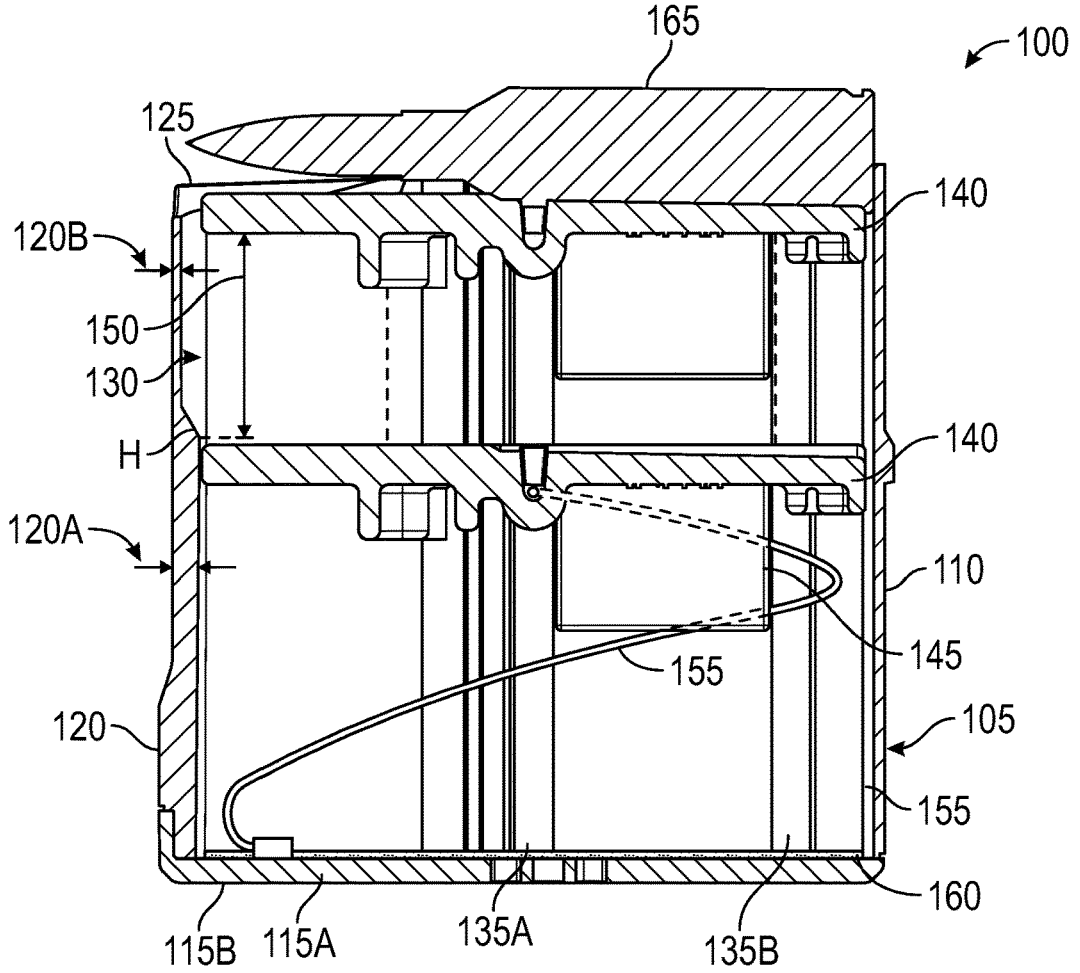
FIG. 1 illustrates a cross sectional view of a cartridge magazine.

FIG. 1 illustrates a cross sectional view of a cartridge magazine 100 taken across a vertical axis of the cartridge magazine. In other words, cartridge magazine is shown without a side wall (e.g., sidewall 225, which will be discussed below). Cartridge magazine 100 may be constructed using a polymer material or a hybrid metallic/polymer material where polymer material is used to coat a metallic magazine. Cartridge magazine 100 may include a housing 105 which incorporates a plurality of sides, including a back wall 110, a bottom side 115A formed with a removable floorplate 115B, a front wall 120, and a top side 125. Ammunition cartridges 165 may be inserted into the magazine through top side 125 and be contained within housing 105 of cartridge magazine 110.

As shown in FIG. 1, front wall 120 may have a particular thickness 120A at a certain point along a height of front wall 120. The relative thickness of front wall 120 may be reduced at a certain point to a thickness 120B. For example, a thickness of front wall 120 may be tapered from a thicker portion of the wall to a portion of the wall that is thinner than the rest of the wall. In practice, a follower 140 may compress a spring 155 to accept ammunition cartridges 165 as ammunition cartridges 165 are installed into housing 105 of cartridge magazine. Magazine 100 may accept a certain number of cartridges. As shown in FIG. 1, magazine 100 accepts three cartridges, although other implementations of the disclosed technology may feature magazines which accept 5, 10, 15, 20, 25, 30, or more ammunition cartridges to suit a desired implementation. In any of these implementations, the follower 140 is always pushed to a certain height within magazine 100 when the magazine is full and spring 155 is compressed to maximum compression (e.g., when the number of cartridges cartridge magazine 100 will accept have been loaded into the magazine). As shown in FIG. 1, that height is indicated by element H. Below element H, in any magazine, housing 105 of cartridge magazine 100 may have a standard thickness, shown as element 120A. Above element H, however, a thickness of front wall 120 may taper down to a thickness 120B, which is less than the thickness of the standard thickness shown as element 120A. In some cases, wall 120 may have less than and up to half the thickness at thickness 120B of wall 120 than wall 120 at standard thickness 120A. This decrease in thickness between thickness 120B creates a recess 130 in front wall 120 that lengthens the overall length of top side 125 to the point where magazine 100 may accept a 6.5 PRC cartridge into the magazine, where magazine 100 is a magazine for a short action rifle action.

More simply, front wall 120 may be tapered in thickness above a point at which spring 155 and follower 140 are fully compressed into cartridge magazine 100 when cartridge magazine 100 is fully loaded with cartridges. This allows 6.5 PRC cartridges to stack appropriately within magazine 100 while tips of ammunition cartridges 165 reside in recess 130 without contacting front wall 120. It is noted, that similar techniques could be implemented on back wall 110 to accommodate 6.5 PRC cartridges such that back wall 110 is implemented with varying thicknesses and a recess to accept the rim of a cartridge case, for example. The techniques disclosed are not limited to only front wall 120 but are described with respect to the front wall 120 for clarity. Back wall 110 may be implemented as described above for the same purposes. Moreover, a front wall 120 and a back wall 120 may be simultaneously modified using the foregoing techniques to reduce a necessary decrease in thickness of both walls to the point where magazine 100 will accept a 6.5 PRC cartridge. The instructive element of the foregoing is that a wall, be it front wall 120 or back wall 110, may be reduced in thickness as necessary to accommodate a length of a 6.5 PRC cartridge.

As shown in FIG. 1, follower 140 is a single element, although shown in two places to illustrate a height difference 150 between a maximum uncompressed height and a maximum compressed height for follower 140 within cartridge magazine 100. Follower 140 may travel between these positions depending on the number of ammunition cartridges loaded into magazine 100 (as shown by dashed lines in FIG. 1). Follower 140 may be connected by spring 150 to a follower plate 160 which interacts with floor plate 115 to lock floor plate 115 in place on the magazine (e.g., one or more elements of follower plate 160 may extend through floor plate 115 to ensure that floor plate 115 is not removed from magazine 100 unless the one or more elements of follower plate 160 are pushed out of engagement with floor plate 115.

Follower 140 may further include a follower guide 145 disposed on one or more left or right sides of follower 140. Follower guide 140 may rest in a groove (shown below) between a first rail 135A and a second rail 135B positioned on the inside of cartridge magazine 100 vertically on a left side and a right side wall of housing 105 of cartridge magazine 100. First rail 135A and second rail 135B on the right side wall may interact with follower guide 145 on a right side of follower 140 to guide follower 140 up and down within cartridge magazine 100. Similarly, first rail 135C and second rail 135D (shown in FIG. 2) on the left side wall may interact with follower guide 145 on a left side of follower 140 to guide follower 140 up and down within cartridge magazine. In other words, follower 100 may be guided up and down in the magazine by first and second rails on opposing side walls of cartridge magazine 100. Follower guide 145 may interact with first and second rails on opposing side walls of cartridge magazine 100 to maintain stability and level as follower 140 travels up and down cartridge magazine 100 as cartridges are loaded into and unloaded from cartridge magazine 100. It is noted that follower 140 does not interact with a front wall 120 or a back wall 120 for stability or any other reason. The only contact between follower 140 and cartridge magazine 100 may be between follower guides 145 and rails 135A-135D as described above. Such an implementation contrasts starkly with previous implementations of magazines which rely on contact or guides disposed on a front or back of a follower to guide a follower through a magazine.

Figure 2:
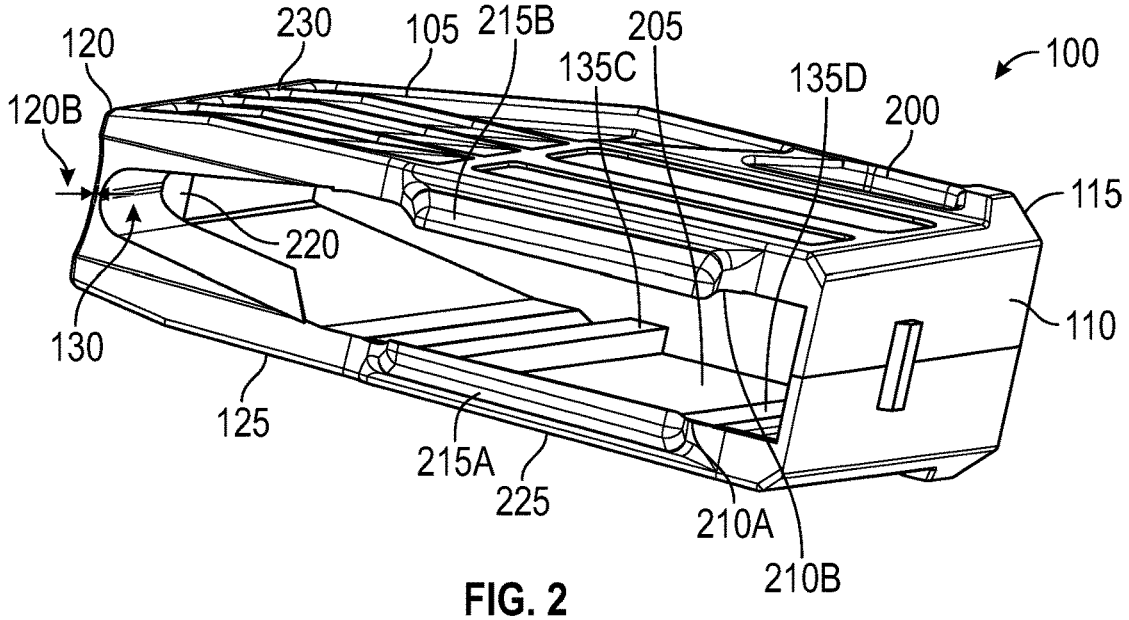
FIG. 2 illustrates a perspective view of a cartridge magazine.

FIG. 2 illustrates a perspective view of a cartridge magazine 100. As shown in FIG. 1, cartridge magazine includes a housing 105, a back wall 110, a bottom side/floorplate 115, a front wall 120, and a top side 125. Front wall 120 is fitted with a reduced thickness 120B at a top end as compared with a thickness of the bottom end of front wall 120, as described above with respect to FIG. 1. This reduced thickness 120B in front wall 120 creates a recess 130 in the structure of at least a portion of front wall 120. As shown in FIG. 2, bottom side 115 is provided with a groove 200 which accepts floorplate 115 to form a bottom wall of magazine 100 when installed. Groove 200 operates to receive floorplate 115 and connect floorplate 115 to a bottom side 115 of magazine 100.

An inside surface of left side wall 225 and an inside surface of right side wall 230 may be fitted with a follower guide groove 205 disposed between sidewall follower guides 135A-135D. For example, left side wall 225 may incorporate a follower guide groove 205 between sidewall follower guides 135A and 135B while right side wall 230 may incorporate a groove 205 between sidewall follower guides 135C and 135D. Follower guide groove 205 mates with follower guide 145, bound by sidewall follower guides 135A-135D to allow follower guide 145 to slide up and down within groove 205. A topmost section of groove 205 disposed on left side wall 225 includes a follower stop 210A while a topmost section of groove 205 on right side wall 230 includes a follower stop 210B. Follower stop 210A and follower stop 210B terminate groove 205 and prevent follower 140 from being pushed out of a top of cartridge magazine 100 by spring 155. Cartridge magazine 100 may further be fitted with feed lip 215A disposed on left side wall 225 and feed lip 215B disposed on right side wall 230 to contain cartridges under pressure from follower 140 and spring 155. Feed lips 215A and 215B also serve to position ammunition in place so that it may be easily contacted by a bolt of a short action rifle and appropriately guided from the magazine and into a chamber of a firearm.

FIG. 2 also illustrates a wall thickness transition point 220 of front wall 120 below recess 130. As discussed with respect to FIG. 1, wall thickness transition point 220 of front wall 120 has a thickness that is greater than a reduced thickness 120B of front wall 120. Wall thickness transition point 220 occurs at a point along front wall 120 where a maximum compression of spring 115 is achieved with a fully loaded magazine (e.g., if a magazine accepts 3 cartridges, the maximum compression of spring 155 is achieved when 3 cartridges have been installed within cartridge magazine 100). Follower 140 may be disposed at a point of front wall 120 that is thicker at wall thickness transition point 220 (e.g., 120A) when the maximum compression of spring 155 is achieved.

Figure 3:
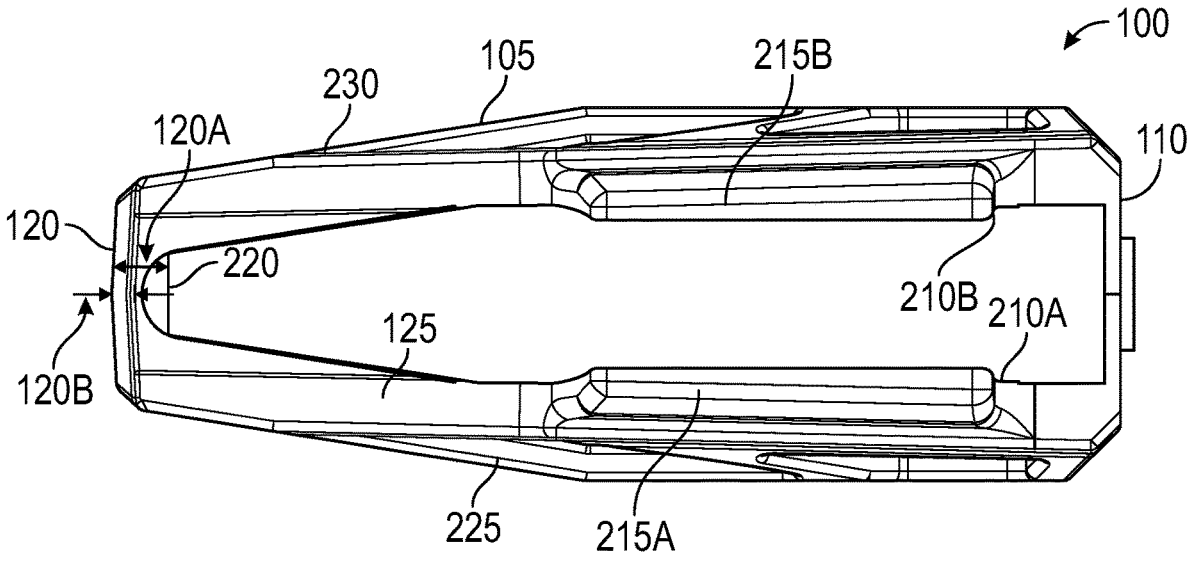
FIG. 3 illustrates a top view of a cartridge magazine.

FIG. 3 illustrates a top view of a cartridge magazine 100. As shown in FIG. 2, cartridge magazine 100 includes a housing 105, a back wall 110, a front wall 120, a right side wall 225, a left side wall 230 and a top side 125. Left side wall 225 and right side wall 230 are fitted with feed lips 215A and 215B, respectively, which are positioned over follower stops 210A and 210B, respectively. FIG. 3 is intended to illustrate a relative thickness of front wall 120 from a top view. Front wall 120 may have a standard thickness 120A which is reduced at wall thickness transition point 220 to a reduced thickness 120B, relative to standard thickness 120A in front wall 120, as shown in FIG. 3. Recess 130, while not shown in FIG. 3 due to perspective may be disposed between wall thickness transition point 220 and a top of cartridge magazine 100 to accommodate 6.5 PRC, or potentially other types of cartridges, in a short action rifle action. By reducing the thickness of front wall 120 at thickness transition point 220, a longer cartridge may be accepted, such as the 6.5 PRC cartridge, that would otherwise not fit within a polymer or polymer hybrid short action rifle magazine.

It is noted, that similar techniques could be implemented on back wall 110 to accommodate 6.5 PRC, or potentially other cartridges, such that back wall 110 is implemented with varying thicknesses and a recess to accept the rim of a cartridge case, for example. The techniques disclosed are not limited to only front wall 120 but are described with respect to the front wall 120 for clarity. Back wall 110 may be implemented as described above for the same purposes. Moreover, a front wall 120 and a back wall 120 may be simultaneously modified using the foregoing techniques to reduce a necessary decrease in thickness of both walls to the point where magazine 100 will accept a 6.5 PRC, or potentially other cartridge. The instructive element of the foregoing is that a wall, be it front wall 120 or back wall 110, may be reduced in thickness as necessary to accommodate a length of a 6.5 PRC, or other cartridge.

Figure 4:
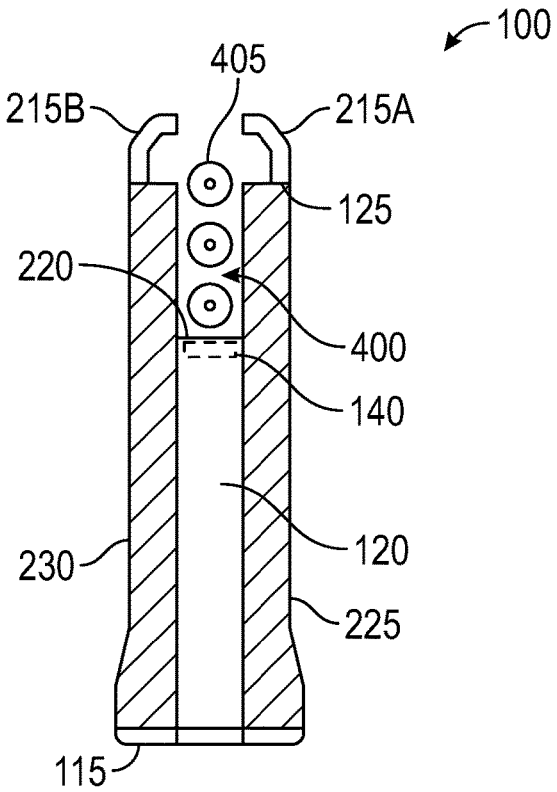
FIG. 4 illustrates a front wall view of a cartridge magazine implementing a cutaway element.

FIG. 4 illustrates a front wall view of a cartridge magazine 100 implementing a cutaway element 400. As shown in FIG. 4, cartridge magazine 100 includes a front wall 120, a left side wall 225, a right side wall 230, a top side 125, and a bottom side 115 with floorplate installed. Top side 125 of cartridge magazine 100 also include feed lips 215A and 215B. Cartridge magazine 100 further includes a follower 140 disposed below a wall thickness transition point 220 as cartridge magazine 100 is fully loaded (in this example) with 3 cartridges of 6.5 PRC ammunition.

Cartridge magazine 100 may include a cutaway 400 in front wall 120 where front wall 120 stops at wall thickness transition point 220. In other words, front wall 120 may have a standard thickness until front wall 120 terminates at wall thickness transition point 220 and transitions into an open cutaway (e.g., no thickness). An open cutaway 400 allows the tip of an ammunition cartridge to move freely in a short action rifle magazine despite being too long to fit in a standard short action rifle magazine made of polymer or polymer hybrid. In other words, instead of providing a front wall with a reduced thickness 120B and a recess 130, it is possible to eliminate front wall 120 above a transition point with cutaway 400.

It is noted that one embodiment of this disclosure is that cartridge magazine may be formed or constructed using polymer or polymer hybrids as discussed above. However, this disclosure is not limiting solely to polymer or polymer hybrid cartridge magazines. It is possible that such techniques may be used in metallic cartridge magazines or metallic hybrid cartridge magazines (e.g. cartridge magazines that are treated with coatings such as anodizing or thin film ceramic coatings). In certain embodiments, such techniques may be used in steel cartridge magazines to form one or more walls of decreased thickness (relative to other walls in the magazine for the purpose of accepting a long cartridge) in the metallic cartridge magazine or to form a cutaway in one or more walls of a metallic cartridge magazine.

Figure 5:
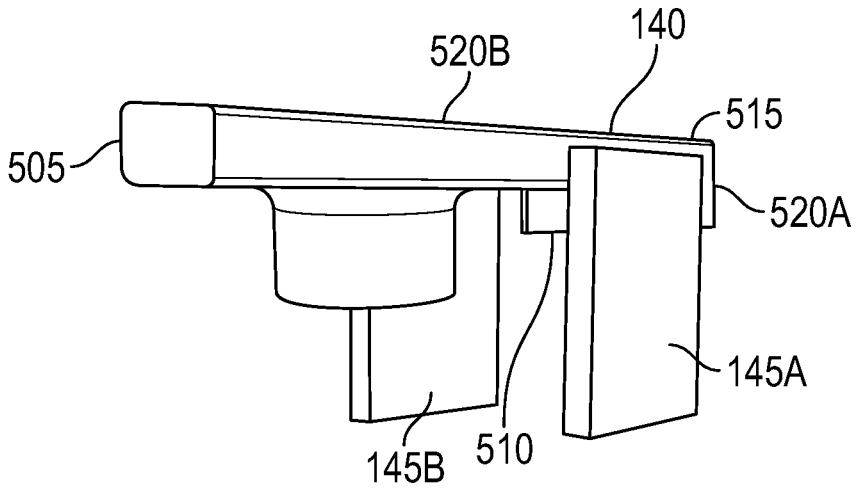
FIG. 5 illustrates a follower contained within the cartridge magazine.

FIG. 5 illustrates a follower 140 of cartridge magazine 100, shown in FIG. 1. Follower 140 may be disposed within cartridge magazine as a component cartridge magazine 100. As previously discussed, a follower 140 may include a first follower guide 145A and a second follower guide 145B disposed on opposing sides of follower 140. Follower guides 145A and 145B may be disposed on follower 140 such that when placed in cartridge magazine 100, follower guides 145A and 145B are adjacent to two walls of the cartridge magazine that are longer than another two walls of the cartridge magazine. For example, follower guides 145A and 145B may be positioned on follower 140 to encounter a left side wall 225 and a right side wall 230 of cartridge magazine 100, respectively, and as shown in, for example, FIG. 2.

FIG. 5 further illustrates a follower tip 505 which may terminate a front end of follower 140 in a manner that prevents follower 140 from being bound or catching on transition point 220, shown in FIG. 2, by follower tip 505, when follower 140 is pushed past transition point 220. In other words, follower tip 505 may be ensure that a length of follower 140 is less than a length of a 6.5 PRC or other cartridge accepted by the magazine, such that a tip of the cartridge may be disposed within recess 130 while follower 140 is disposed below transition point 220. Follower 140 may further include a spring connector 510 which connects follower 140 to spring 155, shown in FIG. 1, to provide spring pressure on follower 140.

Follower 140 may further include a top section 515 which interfaces with ammunition cartridges held within cartridge magazine 100. Top section 515 may be a highest point on follower 140 and visible through a top of cartridge magazine 100 when cartridge magazine 100 is empty. Follower 140 may further include stop tabs 520A and 520B disposed on opposing sides of follower 140 above follower guides 145A and 145B, respectively. Stop tabs 520A and 520B are protrusions which extend from follower 140 in a direction that is perpendicular to the corresponding follower guide 145A and 145B. In other words, stop tab 520A may be a protrusion which extends from follower 140 in a direction that is perpendicular to follower guide 145A. Similarly, stop tab 520B may be a protrusion which extends from follower 140 in a direction that is perpendicular to follower guide 145B. Stop tabs 520A and 520B may interact with follower stops 210A and 210B, respectively, as shown in FIG. 2. For example, when empty, follower 140 of cartridge magazine 100 may interact with follower stops 210A and 210B by stop tabs 520A and 520B coming into contact with follower stops 210A and 210B. Follower stops 210A and 210B may be sized to interact with stop tabs 520A and 520B to prevent spring pressure on follower 140 from pushing follower out of cartridge magazine 100 from a top side.

In practice, cartridge magazine may be constructed from a back wall 110, a left side wall 225, a right side wall 230, and a front wall 120. Back wall 110, left side wall 225, right side wall 230, and front wall 120 may be referred to as one of four walls, or a plurality of walls. Left side wall 225 and right side wall 230 may be disposed at angles orthogonal to back wall 110 and front wall 120. Left side wall 225 and right side wall 230 may be mirrors of each other and be implemented as being longer in length than back wall 110 or front wall 120. In one wall, a recess 130 may be disposed to accommodate longer ammunition cartridges than would typically fit in a short action rifle magazine. Recess 130 may be created by thinning a thickness of the one wall to the point where recess 130 is disposed in the one wall. It may be that two walls are similarly arranged with recesses, such as recess 130, to accommodate another ammunition cartridge than would normally fit in a short action rifle magazine.

Two other walls, such as side walls 225 and 230 may include two sidewall follower guides each 135A-135D which allow a follower 140 to slide up and down a height of cartridge magazine 100 to accept ammunition cartridges. Follower 140 incorporates follower guides 145A and 145B which may be disposed in mechanical cooperation with sidewall follower guides 135A-135D to allow follower 140 to slide up and down the height of cartridge magazine 100 while also ensuring that the travel of follower 140 up and down the height of cartridge magazine 100 is guided to ascend and descend in a smooth and even fashion along a constant height for follower 140. Sidewall follower guides 135A and 135B may interact with follower guide 145A while sidewall follower guides 135C and 135D may interact with follower guide 145B. In this manner, the only contact between cartridge magazine 100 and follower 140 during up and down travel of follower 140 in cartridge magazine 100 may be between sidewall follower guides 135A-135D and follower guides 145A and 145B. Contact may also occur between follower 140 and cartridge magazine when stop tabs 520A and 520B interact with follower stops 210A and 210B when cartridge magazine 100 is empty.

The foregoing description has been presented for the purposes of illustration and description. It is not intended to be exhaustive or to limit the disclosure to the precise form disclosed. Many modifications and variations are possible in light of the above disclosure and teachings. Further, it should be noted that any or all of the aforementioned alternate implementations may be used in any combination desired to form additional hybrid implementations of the disclosure. For example, components described herein may be removed and other components added without departing from the scope or spirit of the embodiments disclosed herein or the appended claims.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

What is claimed is:

1. A cartridge magazine, comprising:
a first wall,
a second wall,
a third wall, and
a fourth wall,
wherein a recess is disposed in a thickness of the first wall on an interior side of the cartridge magazine, the recess extending from a top side of the cartridge magazine along at least a portion of the first wall of the cartridge magazine.

2. The cartridge magazine of claim 1, wherein the first wall includes a transition point at which a thickness of the first wall transitions from thinner at a top portion of the cartridge magazine to thicker after the transition point.

3. The cartridge magazine of claim 2, further comprising a follower.

4. The cartridge magazine of claim 3, wherein the follower is sized to be disposed in the magazine at a point between the transition point and a bottom of the cartridge magazine.

5. The cartridge magazine of claim 4, wherein the follower is sized to terminate in length before the recess.

6. The cartridge magazine of claim 1, wherein the first wall is a front wall of the cartridge magazine.

7. The cartridge magazine of claim 1, wherein the first wall is a back of the cartridge magazine.

8. The cartridge magazine of claim 1, wherein the first wall is a front wall of the cartridge magazine and a second wall is a back of the cartridge magazine, wherein a recess is formed in the front wall and wherein a recess is also formed in the back wall.

9. The cartridge magazine of claim 1, wherein the recess extends through the first wall as a cutaway portion of the first wall.

10. The cartridge magazine of claim 1, wherein the cartridge magazine is constructed as one of either a polymer cartridge magazine or a polymer hybrid cartridge magazine.

11. The cartridge magazine of claim 1, wherein the cartridge magazine is a cartridge magazine for a short action rifle action.

12. A cartridge magazine, comprising:
a front wall, the front wall having a recess disposed in a thickness of the front wall on an interior side of the cartridge magazine, the recess extending from a top side of the cartridge magazine along at least a portion of the front wall of the cartridge magazine, and
a plurality of walls of the cartridge magazine.

13. The cartridge magazine of claim 12, wherein the plurality of walls comprise a left side wall, a right side wall, and a back wall.

14. The cartridge magazine of claim 13, wherein the back wall further comprises a recess disposed in a thickness of the back wall, the recess extending from a top side of the cartridge magazine along a least a portion of the back wall of the cartridge magazine.

15. The cartridge magazine of claim 12, further comprising a transition point in the front wall, at which a thickness of the front wall transitions from thinner at a top portion of the cartridge magazine to thicker after the transition point towards a bottom of the cartridge magazine.

16. The cartridge magazine of claim 15, wherein the transition point tapers a thickness of the front wall from a thicker portion of the wall below the transition point in the cartridge magazine and to a thinner portion of the wall above the transition point in the cartridge magazine.

17. The cartridge magazine of claim 12, wherein the recess extends through the first wall as a cutaway portion of the first wall.

18. The cartridge magazine of claim 12, wherein the cartridge magazine is constructed as one of either a polymer cartridge magazine or a polymer hybrid cartridge magazine.

19. The cartridge magazine of claim 12, wherein the cartridge magazine is a cartridge magazine for a short action rifle action.

20. The cartridge magazine of claim 12, further comprising a follower, wherein the follower is sized to be disposed in the magazine at a point between a transition point and a bottom of the cartridge, the transition point being a point at which a thickness of the front wall transitions from thinner at a top portion of the cartridge magazine to thicker after the transition point towards a bottom of the cartridge magazine.

* * * * *